US006604330B2

(12) United States Patent
Repasky

(10) Patent No.: US 6,604,330 B2
(45) Date of Patent: Aug. 12, 2003

(54) BALLAST BLOCK DECK SYSTEM AND PEDESTAL ASSEMBLY THEREFOR

(76) Inventor: John Repasky, 140 Bender Rd., Hanover, PA (US) 17331

( * ) Notice: Subject to any disclaimer, the term of this patent is extended or adjusted under 35 U.S.C. 154(b) by 0 days.

(21) Appl. No.: 09/958,042

(22) PCT Filed: May 22, 2001

(86) PCT No.: PCT/US01/16407

§ 371 (c)(1),
(2), (4) Date: Oct. 1, 2001

(87) PCT Pub. No.: WO01/90497

PCT Pub. Date: Nov. 29, 2001

(65) Prior Publication Data

US 2002/0157339 A1 Oct. 31, 2002

Related U.S. Application Data

(60) Provisional application No. 60/207,088, filed on May 25, 2000.

(51) Int. Cl.[7] ..... E04B 1/00

(52) U.S. Cl. ..... 52/263; 52/126.1; 52/126.6; 411/395

(58) Field of Search ..... 52/126.1, 126.6, 52/263; 411/395

(56) References Cited

U.S. PATENT DOCUMENTS

| | | | | |
|---|---|---|---|---|
| 126,366 A | * | 4/1872 | Wills | 411/387.4 |
| 4,506,483 A | | 3/1985 | Phalen, Jr. | 52/408 |
| 4,546,580 A | | 10/1985 | Ueno et al. | |
| 4,570,397 A | | 2/1986 | Creske | |
| 4,578,910 A | | 4/1986 | Germeroth et al. | |
| 4,621,468 A | | 11/1986 | Likozar | |
| 4,663,909 A | | 5/1987 | Ogino et al. | 52/302 |
| 4,922,670 A | | 5/1990 | Naka et al. | |
| 4,996,804 A | | 3/1991 | Naka et al. | |
| 5,052,157 A | | 10/1991 | Ducroux et al. | |
| 5,072,557 A | * | 12/1991 | Naka et al. | 52/126.6 |
| 5,333,423 A | * | 8/1994 | Propst | 52/126.6 |
| 5,377,468 A | | 1/1995 | Repasky | |
| 5,442,882 A | * | 8/1995 | Repasky | 52/105 |
| RE35,369 E | | 11/1996 | Ducroux et al. | |
| 5,588,264 A | | 12/1996 | Buzon | |
| 5,887,397 A | | 3/1999 | Repasky | |

FOREIGN PATENT DOCUMENTS

| | | |
|---|---|---|
| JP | 5-8304 | 2/1993 |

* cited by examiner

*Primary Examiner*—Carl D. Friedman
*Assistant Examiner*—Steve M. Varner
(74) *Attorney, Agent, or Firm*—Howson and Howson

(57) ABSTRACT

A ballast block deck system includes a plurality of ballast blocks (12) laterally positioned to form an elevated deck (14) on an existing roof structure. Each block (12) has a predetermined thickness and multiple corner portions (22). A pedestal assembly (30) is located directly beneath the corner portions (22) of adjacent ballast blocks (12) to space and support the blocks (12) a spaced distance above the existing roof surface. The pedestal assembly (30) includes a support plate (34) having a support surface (40) for supporting the corner portions (22) thereon, a cornercap (42) which overlies the corner portions (22), and a fastener (44) which removably attaches the cornercap (42) to the support plate (34). When installed, the corner portions (22) of adjacent ballast blocks (12) are captured between the support plate (34) and cornercap (42) of the pedestal (30). Preferably, the corner portions (22) of the ballast blocks (12) include a recessed area (18) so that the cornercap (42) lies flush with the top surface (16) of the ballast blocks (12), and preferably, the corner portions (22) have a groove (20) for cooperatively engaging a flange (56) depending from the cornercap (42) so that lateral movement of the blocks (12) relative to the pedestal (30) and to other blocks (12) is prevented.

19 Claims, 4 Drawing Sheets

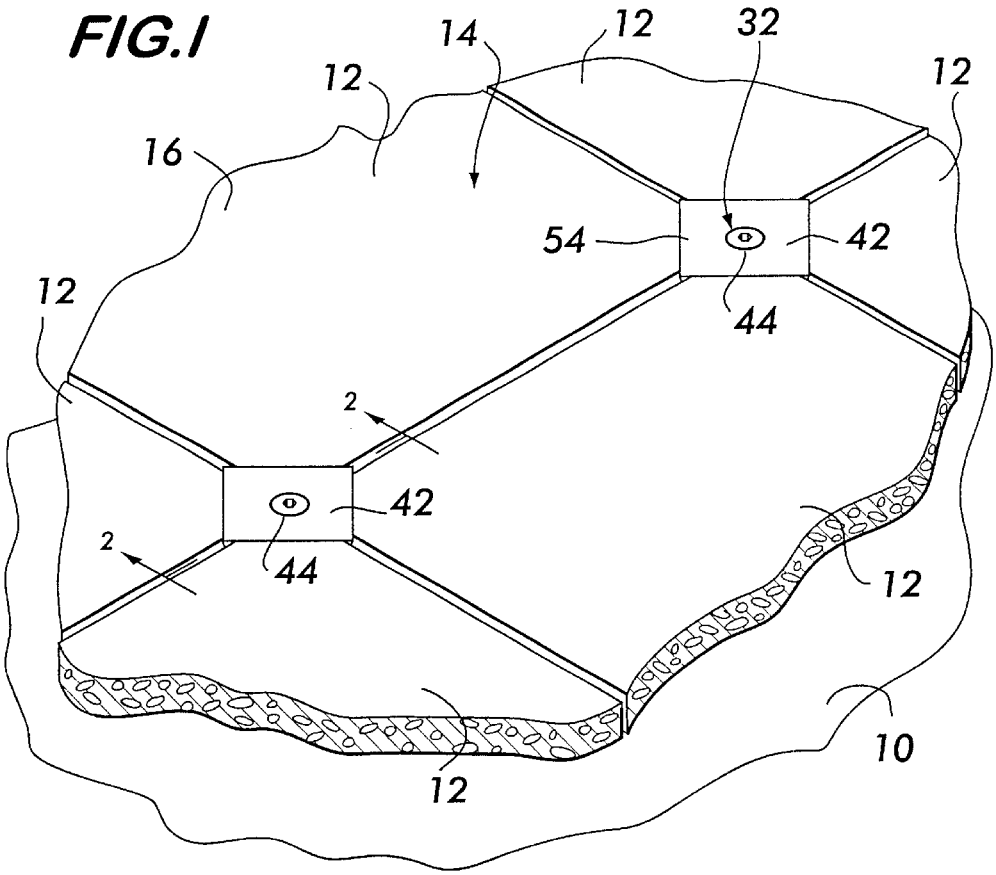
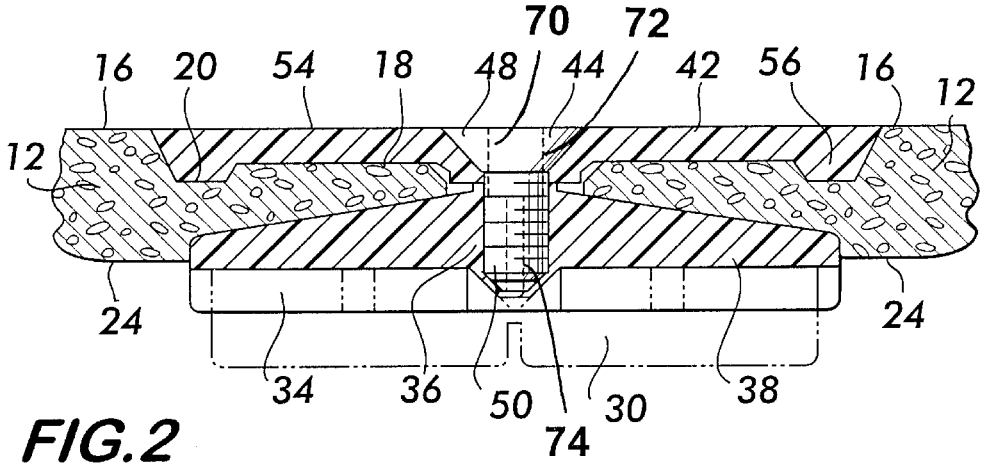
FIG.2

BALLAST BLOCK DECK SYSTEM AND PEDESTAL ASSEMBLY THEREFOR

This application claims the benefit of provisional application Ser. No. 60/207,088 filed May 25, 2000.

FIELD OF THE INVENTION

The present invention relates generally to a deck paver system for use in providing an elevated traffic-bearing surface on an existing roof of a building, and more particularly, the present invention relates to an aerodynamically stable deck paver system utilizing pedestal assemblies which engage and secure ballast blocks in an elevated position relative to the roof.

BACKGROUND OF THE INVENTION

Many buildings are constructed with slightly inclined roof structures that are capable of supporting a substantially horizontal surface, or deck, enabling the roof to be used as a patio or the like. Typically, such a roof surface is sloped at a given angle from the horizontal for the purpose of draining rainfall and melted snow and ice. The roof surface itself is generally made of a material which does not provide a suitable traffic bearing surface and which is aesthetically unpleasing.

Examples of aerodynamically stable roof paver systems are provided by U.S. Pat. Nos. 5,887,397 and 5,377,468 issued to Repasky. The disclosed systems utilize footed and interlocking ballast blocks designed to resist lifting when exposed to high velocity winds.

Non-interlocking ballast blocks systems are disclosed in U.S. Pat. No. 5,442,882 issued to Repasky, U.S. Pat. No. 4,570,397 issued to Creske, and U.S. Pat. No. 5,588,264 issued to Buzon. Pedestals are utilized to support and level a series of non-interlocking ballast blocks. However, since the non-interlocking ballast blocks merely rest on the pedestals and are not otherwise secured together or to the pedestals, the blocks are more prone to become lifted by high velocity winds as compared to interlocking ballast blocks.

U.S. Pat. No. 5,546,580 issued to Ueno et al. discloses a heat insulation rooftop system which includes the use of heat insulation panels and upper protective panels supported on pedestals above an existing rooftop surface. The system utilizes cornercaps which are secured to the pedestals and overlie the corner portions of protective panels so that the protective panels are captured to the pedestals.

Various indoor elevated floor panel systems are also known which utilize pedestals to support floor panels. For example, see U.S. Pat. No. 5,333,423 issued to Propst; U.S. Pat. No. 4,621,468 issued to Likozar; U.S. Pat. No. 5,052,157 and corresponding Re. Pat. No. 35,369 issued to Ducroux et al.; U.S. Pat. No. 4,578,910 issued to Germeroth et al.; and U.S. Pat. Nos. 4,922,670, 4,996,804 and 5,072,557 issued to Naka et al. In particular, the Propst patent discloses removable floor panels which are supported at their corners on pedestals and which are locked to the pedestals by overlying cornercaps fastened to the pedestals via lock-down screws.

While the rooftop ballast block and indoor floor panel systems disclosed in the above referenced patents may function satisfactorily under certain circumstances, there is a need for an improved rooftop ballast block system which remains stable in high velocity winds. The system should permit proper drainage to the underlying roof surface and should include means for interlocking the corners of adjacent ballast blocks. Preferably, the ballast blocks should be secured to pedestals in a manner which resists both upward and relative lateral movement of the ballast blocks. In addition, the ballast block system should be capable of being efficiently manufactured and installed and should be capable of use with stackable-type pedestals which provide a leveling function.

OBJECTS OF THE INVENTION

With the foregoing in mind, a primary object of the present invention is to provide an improved and economical ballast block deck system for forming an elevated traffic-bearing surface on an existing roof of a building. The system should be capable of being readily and properly installed in a manner requiring labor skills possessed by the average deck installer.

Another object of the present invention is to provide a ballast block deck system which utilizes pedestals to support, level and lockingly engage ballast blocks so that the deck is capable of remaining stable during high wind conditions.

A further object of the present invention is to provide an improved pedestal assembly for supporting and capturing ballast blocks so that the ballast blocks are prevented from unwanted upward or lateral movement.

SUMMARY OF THE INVENTION

More specifically, the present invention provides a ballast block deck system including a plurality of ballast blocks which are laterally positioned in a grid pattern to form an elevated deck on an existing roof structure. Each of the ballast blocks has a predetermined thickness and multiple corner portions, and the grid pattern includes intersection areas into which corner portions of adjacent ballast blocks extend. A pedestal assembly is located directly beneath one of the intersection areas and supports the corner portions of the adjacent ballast blocks a spaced distance above the existing roof surface.

The pedestal assembly includes a support plate having a support surface for supporting the corner portions thereon, a cornercap which overlies the corner portions, and a fastener which removably attaches the cornercap to the support plate. When installed, the corner portions of adjacent ballast blocks within an intersection area of the grid are captured between the support plate and cornercap of the pedestal. Preferably, the corner portions of the ballast blocks include a recessed area so that the cornercap lies flush with the top surface of the ballast blocks, and preferably, the corner portions have a groove for cooperatively engaging a flange depending from the cornercap so that lateral movement of the blocks relative to the pedestal and to other blocks is prevented.

According to another aspect of the invention, a pedestal assembly is provided for supporting a ballast block deck. The pedestal assembly includes an upper support plate, a removable cap and a fastener as described above.

BRIEF DESCRIPTION OF THE DRAWINGS

The foregoing and other objects, features and advantages of the present invention should become apparent from the following description when taken in conjunction with the accompanying drawings, in which:

FIG. 1 is a perspective view of a ballast block deck system embodying the present invention;

FIG. 2 is an elevational cross sectional view of the ballast block deck system along the line 2—2 illustrated in FIG. 1;

DETAILED DESCRIPTION OF THE PREFERRED EMBODIMENT

Figure 3:
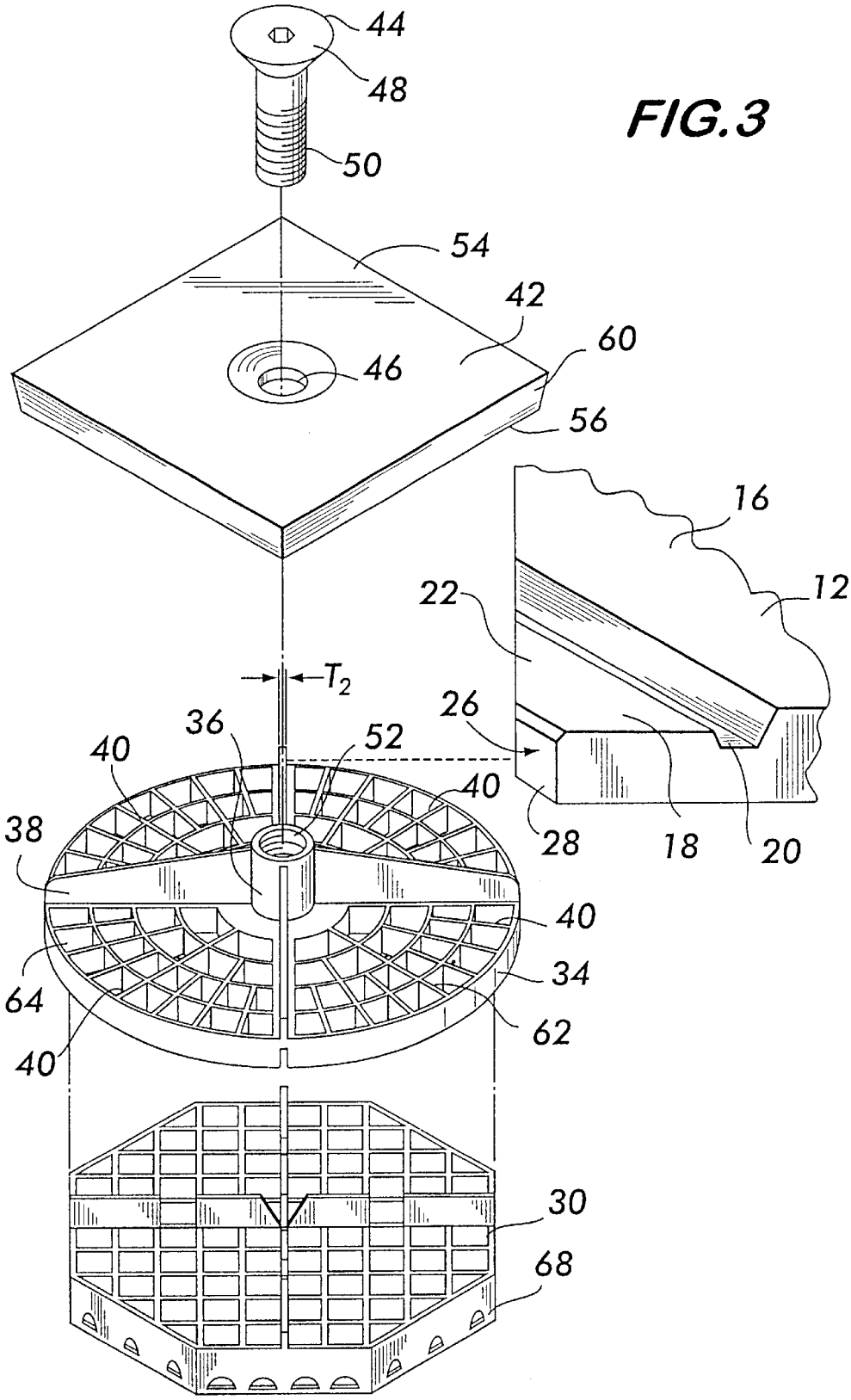
FIG. 3 is an exploded perspective view of the ballast block deck system, the view taken from above the top surface of the ballast block.
Figure 4:
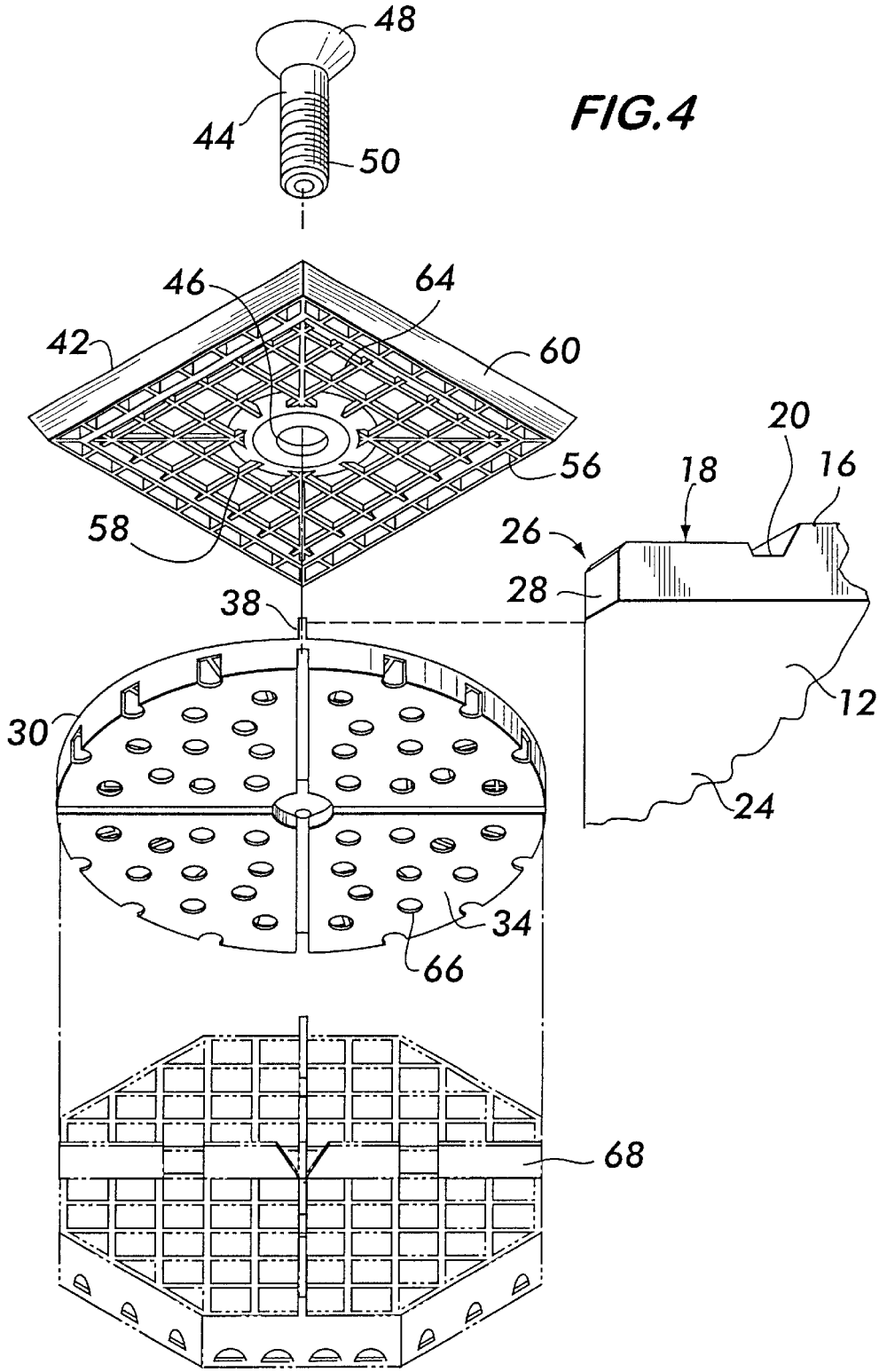
FIG. 4 is an exploded perspective view of the ballast block deck system, the view taken from below the bottom surface of the ballast block.

Referring now to the drawings, FIG. 1 illustrates a portion of an exterior surface 10 of an existing roof of a building or like structure. A series of rectangular ballast blocks 12 are arranged in a grid layout, or pattern, and are supported a spaced distance above the exterior roof surface 10 to provide a substantially level traffic-bearing surface 14. The surface 14 provides an aesthetic appearance and converts otherwise unusable rooftop space into a patio or the like.

Preferably, as illustrated, each ballast block 12 is made of concrete and is substantially square in plan. Each block 12 is provided with a substantially flat top surface 16 except for recesses 18 and grooves 20 formed in the corner portions 22 of the blocks 12. Preferably, each block has a substantially flat bottom surface 24, and each corner 26 is truncated to provide an end wall 28. The top and bottom surfaces, 16 and 24, are substantially parallel and define a thickness "T1" of the block 12 which can be, for instance, within a range of about 1.5 to 3.0 inches. Of course, ballast block having other shapes, surface characteristics, thicknesses and the like can be utilized In addition, other types of layouts or patterns of ballast blocks can be utilized.

As disclosed in U.S. Pat. No. 5,442,882, the disclosure of which is herein incorporated by reference, pedestals 30 are utilized to support the corner portions 22 of adjacent ballast blocks 12. To this end, one pedestal 30 is located directly beneath each intersection area 32 of the grid layout of ballast blocks 12 so that the entire deck is elevated a space distance from the exterior roof surface 10. The spacing provided between the blocks 12 and roof surface 10 and the spacing between laterally positioned blocks 12 permit proper drainage of fluids, such as rain, through the ballast block deck to the roof.

As best illustrated in FIG. 3, each pedestal includes an upper support plate 34 which has a central upstanding hub 36 and upstanding walls 38 extending radially therefrom. The hub 36 is positioned at the intersection of four blocks 12, and the upstanding walls 38 define separate support surface quadrants 40 so that the corner portions of four adjacent blocks 12 can be readily positioned on the support plate 34. The thickness "T2" of the upstanding walls 38 aids in defining the requisite drainage spacing between adjacent blocks 12.

Each pedestal 30 includes a removable cap, or cornercap, 42 which can be connected to the support plate 34. The cap 42 overlies the corner portions 22 of the four adjacent blocks 12 to capture the blocks 12 to the pedestal 30 at the intersection area 32. Thus, the entire deck is structurally tied together to better resist unwanted movement due to high wind conditions which may be experienced on a rooftop of a building, such as a high rise building.

A fastener 44 is utilized to secure the cap 42 to the support plate 34. To this end, the fastener 44 extends through a central aperture 46 in the cap 42 and lockingly engages the central hub 36 of the support plate 34. Preferably, the fastener 44 is a screw with a head 48 which is engaged by the cap 42 and a threaded shaft 50 which is engaged by a threaded aperture 52 located within the hub 36. As illustrated, the plastic fastener 44 is molded with a central channel 70. The upper half 72 of the central channel 70 is shaped to cooperatively mate with an allen wrench for purposes of tightening the fastener, and the lower half 74 of the central channel 70 provides a drainage path through the fastener 44 for rainwater and the like. Of course, other fasteners can be utilized to connect the cap 42 to the support plate 34 in a manner which captures the corner portions of the blocks to the pedestals 30.

Figure 5:
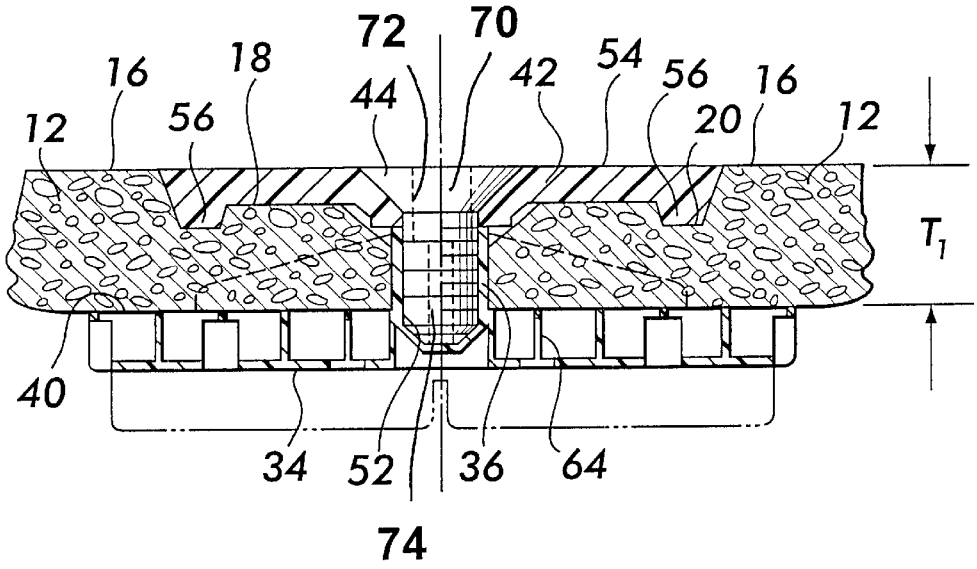
FIG. 5 is an elevational cross sectional view of the ballast block deck system as in FIG. 2 except with line 2—2 being rotated 45° about the fastener.

As best illustrated in FIGS. 2 and 5, the cap 42 confronts the recessed areas 18 of the ballast blocks 12 so that the top surface 54 of the cap 42 lies flush with the top surface 16 of the ballast blocks 12. In addition, preferably a flange 56 depends from the cap 42 and extends within the grooves 20 formed in the corner portions 22 of the ballast blocks 12. Thus, the grooves 20 and flange 56 provide a complementary locking means for preventing lateral movement of the ballast blocks 12 relative to the pedestal 30 and relative to other ballast blocks 12 forming the remaining portion of the deck. Of course, other complementary locking means can be provided on the cap and blocks to provide the above stated function.

The illustrated embodiment of the corner portions 22 of the ballast blocks 12 according to the present invention are best illustrated in FIG. 3. The corners 26 of the blocks 12 are truncated and form an endwall 28 which, when positioned on the support plate 34, provides clearance for the hub 36 of the support plate 34. The groove 20 formed in the corner portion 22 of the block 12 is spaced from and extends substantially parallel to the endwall 28, and the ballast block 12 is recessed between each endwall 28 and each groove 20. Thus, in the illustrated embodiment, each corner portion 22 is defined by a trapezoidal shaped section from the endwall 28 to the groove 20. The groove 20 extends to a greater depth into the ballast block 12 than the recessed area 18 to enable lateral locking of the block 12 to the pedestal 30.

As an example of the dimensions of a ballast block 12 according to the present invention, each block is about 23.5 by 23.5 inches in plan. Each corner portion 22 is truncated such that the length of each endwall 28 is about 1.5 inches. The groove 20 extends to a depth of about 0.625 inch from the top surface 16 of the block 12, and the recessed area 18 extends to a depth of about 0.375 inch from the top surface of the block 12. The grooves 20 are formed by beveled walls which extend at an angle of about 60° from the horizontally-disposed top surface 16 of the block 12. The edge of the groove 20 closest to the endwall 28 is parallel to the endwall 28 and is spaced about 2.125 inches from the endwall 28. The edge of the groove 20 furthest from the endwall 28 is spaced about 3 inches from the endwall 28.

The cap 42 in the illustrated embodiment is square in plan and overlies the corner portions 22 of the ballast blocks 12. The flange 56 depends from the bottom side 58 of the cap 42 adjacent the outer periphery 60 of the cap 42 and extends continuously along the cap outer periphery 60. The central aperture 46 of the cap 42 is recessed to permit the head 48 of the fastener 44 to be seated flush with the top surface 16 of the ballast blocks 12. Caps having other shapes can also be utilized. For instance, the caps can be circular in plan, and the depending flange have an arcuate shape. Alternatively, other shapes of caps and flanges could be utilized including discontinuous or multiple rows of depending flanges.

The support plate 34, cap 42 and fastener 44 are preferably made of a durable plastic. The top surface 62 of the support plate 34 and the underside 58 of the cap 42 can be molded such that they have a plurality of reinforcement ribs 64 to reduce the amount of plastic required to make the components and to provide a sturdy pedestal structure. In addition, preferably the support plate 34 is provided with a plurality of drainage apertures 66.

The support plate 34 is preferably structured to be stacked on a stackable pedestal 68 as disclosed in U.S. Pat. No. 5,442,882. To this end, multiple level compensators can be stacked together to provide a level support surface at a predetermined height above the existing roof surface 10.

The above-described ballast block deck system and pedestal assembly according to the present invention provides a stable elevated traffic bearing surface on an existing rooftop. The deck is easy to install and inexpensive to manufacture. A set of fasteners 44 of various lengths can be provided with each pedestal 30 so that a fastener of an appropriate length can be used depending on the thickness "T1" of the ballast block 12. Preferably, the appropriate length fastener 44 is slightly longer in length than the thickness "T1" of the ballast block 12.

While a preferred ballast block deck system and pedestal assembly have been described in detail, various modifications, alterations, and changes may be made without departing from the spirit and scope of the ballast block deck system and pedestal assembly according to the present invention as defined in the appended claims.

What is claimed is:

1. A ballast block deck system for forming an elevated surface (14) on an existing roof structure, comprising:

a plurality of ballast blocks (12) laterally positioned in a pattern to form a deck, each of said ballast blocks (12) having a predetermined thickness (T1) and multiple corner portions (22), said pattern including intersection areas (32) in which corner portions (22) of adjacent ballast blocks (12) extend, said corner portions (22) of said ballast blocks (12) each having a top surface (16) with an upwardly open groove (20) and a recessed area (18), said groove (20) extending to a greater depth within the ballast block (12) than said recessed area (18);

a pedestal assembly (30) located directly beneath one of said intersection areas (32) for supporting said corner portions (22) of said adjacent ballast blocks (12) a spaced distance above the existing roof surface;

said pedestal assembly (30) including a support plate (34) having a support surface for supporting said corner portions (22) of said adjacent ballast blocks (12) thereon, and said pedestal assembly (30) including a removable cap (42) which overlies said corner portions (22) of said adjacent ballast blocks (12) and a fastener (44) which removably attaches said cap (42) to said support plate (34) so that said corner portions (22) of said adjacent ballast blocks (12) are captured between said support plate (34) and said cap (42).

2. A ballast block deck system according to claim 1, wherein said cap(42) and said corner portions (22) have complementary locking means.

3. A ballast block deck system according to claim 2, wherein said complementary locking means of said cap (42) is a flange (56) which depends from said cap (42), and wherein said complementary locking means of said corner portions (22) is said upwardly opened groove (20).

4. A ballast block system according to claim 2, wherein said support plate (34) has a plurality of radially extending upstanding walls (38) which define quadrants (40) on said support surface, and wherein each of said quadrants (40) supports one of said corner portions (22) of said adjacent ballast blocks (12).

5. A ballast block deck system according to claim 3, wherein said cap (42) has a top surface (54), and wherein said recessed areas (18) of said corner portions (22) permit said top surface (54) of said cap (42) to lie flush with said top surface (16) of said ballast blocks (12).

6. A ballast block deck system according to claim 3, wherein said cap (42) has a peripheral edge (60), and wherein said flange (56) depends from said cap (42) adjacent said peripheral edge (60).

7. A ballast block deck system according to claim 6, wherein said flange (56) extends continuously along said peripheral edge (60) of said cap (42).

8. A ballast block deck system according to claim 4, wherein said upstanding walls (38) on said support plate (34) have a thickness (T2) which is substantially equal to and defines a laterally spacing between said adjacent ballast blocks (12) to permit drainage of fluid through said deck to the underlying existing roof surface.

9. A ballast block deck system according to claim 8, wherein said fastener (44) is a screw having a head (48) and a threaded shaft (50), said cap (42) has a central aperture (46) for engaging said head (48), and said support plate (34) has a centrally located threaded aperture (52) for engaging said threaded shaft (50).

10. A ballast block system according to claim 8, wherein said support plate (34) is stackably received on said pedestal assembly (30) and wherein said pedestal assembly (30) includes at least two stackable members (34, 68).

11. A ballast block system according to claim 8, wherein said pedestal assembly (30) is made of a moldable plastic material.

12. A ballast block system according to claim 9, wherein said screw has a length which is greater than said thickness of said ballast blocks (12).

13. A ballast block system according to claim 9, wherein said screw has a central channel (70) extending axially therethrough to provide a drainage path therethrough.

14. A ballast block deck system for forming an elevated surface (14) on an existing roof structure, comprising:

a plurality of ballast blocks (12) each having top and bottom surfaces (16, 24) and each having corner portions (22), said top surfaces (16) in said corner portions (22) each having an upwardly open groove (20) and a recessed area (18), said groove (20) having a greater depth than said recessed area (18);

a pedestal assembly (30) extending from the existing roof surface and supporting multiple corner portions (22) of adjacent ballast blocks (12) a spaced distance above the existing roof surface;

said pedestal assembly (30) having a support plate (34) with a plurality of upstanding walls (38) defining separate support surfaces (40) on said support plate (34), each of said support surfaces (40) engaging said bottom surface (24) of one said corner portions (22) of said adjacent ballast blocks (12);

said pedestal assembly (30) having a cap (42) overlying said corner portions (22) of said adjacent ballast blocks (12), said cap (42) being seated in said recessed areas (18) so that said cap (42) lies substantially flush with said top surfaces (16) of said adjacent ballast blocks (12) and having a flange (56) depending into said grooves (20); and said pedestal assembly (30) having a hold-down fastener (44) which removably attaches said cap (42) to said support plate (34).

15. A ballast block deck system according to claim 14, wherein said upstanding walls (38) on said support plate (34) have a thickness (T2) which is substantially equal to and defines a laterally spacing between said adjacent ballast blocks (12) to permit drainage of fluid through said deck to the underlying existing roof surface.

16. A ballast block (12) for use in forming an elevated deck on an existing roof structure, comprising at least four corner portions (22) having a top surface (16) each having an upwardly open groove (20) and a recessed area (18), said grooves (20) extending to a greater depth within the ballast block (12) than said recessed areas (18).

17. A ballast block (12) according to claim 16, wherein said corner portions (22) of the ballast block (12) are truncated forming a vertical endwall (28).

18. A ballast block (12) according to claim 17, wherein in each of said corner portions (22) said groove (20) extends substantially parallel to said endwell (28), and said recessed area (18) extends between said endwell (28) and said groove (20).

19. A ballast block (12) according to claim 18, wherein each of said recessed areas (18) is trapezoidal in shape.

* * * * *